US007080630B1

(12) United States Patent
Buslepp et al.

(10) Patent No.: US 7,080,630 B1
(45) Date of Patent: Jul. 25, 2006

(54) METHOD FOR CALCULATING CYLINDER CHARGE DURING STARTING

(75) Inventors: Kenneth J. Buslepp, Brighton, MI (US); Douglas R. Verner, Sterling Heights, MI (US); David P. Sczomak, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/218,246

(22) Filed: Sep. 1, 2005

Related U.S. Application Data

(60) Provisional application No. 60/681,862, filed on May 17, 2005.

(51) Int. Cl.
*F02D 41/06* (2006.01)

(52) U.S. Cl. ..... 123/491; 123/685; 123/179.17; 701/113

(58) Field of Classification Search ..... 123/179.17, 123/491, 685; 701/113
See application file for complete search history.

(56) References Cited

U.S. PATENT DOCUMENTS

| | | | | | |
|---|---|---|---|---|---|
| 4,411,234 | A * | 10/1983 | Middleton | 123/179.16 |
| 5,497,329 | A * | 3/1996 | Tang | 123/480 |
| 5,595,161 | A * | 1/1997 | Ott et al. | 123/491 |
| 5,654,501 | A * | 8/1997 | Grizzle et al. | 73/118.2 |
| 5,983,868 | A * | 11/1999 | Ichinose | 123/491 |
| 2004/0163629 | A1 * | 8/2004 | Strayer et al. | 123/491 |
| 2004/0200458 | A1 * | 10/2004 | Lewis et al. | 123/491 |
| 2005/0228575 | A1 * | 10/2005 | Murakami et al. | 701/113 |

* cited by examiner

*Primary Examiner*—Erick R Solis
(74) *Attorney, Agent, or Firm*—Christopher DeVries

(57) ABSTRACT

A system and method to control fuel delivery to an engine at startup includes a crank sensor that determines a rotational position of the engine. A control module calculates an air mass of a first cylinder based on the rotational position of the engine and delivers fuel to the first cylinder based on the air mass. The air mass is based on a volume, a pressure and a temperature of the first cylinder.

20 Claims, 3 Drawing Sheets

METHOD FOR CALCULATING CYLINDER CHARGE DURING STARTING

CROSS-REFERENCE TO RELATED APPLICATIONS

This application claims the benefit of U.S. Provisional Application No. 60/681,862, filed on May 17, 2005. The disclosure of the above application is incorporated herein by reference.

FIELD OF THE INVENTION

The present invention relates to engine control systems and more particularly to engine control systems for determining cylinder charge during startup.

BACKGROUND OF THE INVENTION

During operation of a four stroke engine, each cylinder has a piston that undergoes an Otto cycle that has an intake, compression, combustion and expansion stroke. Typically, each piston of a multiple cylinder engine undergoes the various strokes at different times relative to other cylinders to facilitate smooth operation. As a result, when the engine stops, each piston may rest at different points in the Otto cycle within their respective cylinders.

Combustion occurs when a spark is delivered to a combination of gasoline and air present in a cylinder. When an engine is started, fuel is delivered sequentially to the cylinders. In some instances however, fuel may be delivered to a cylinder that does not have sufficient air to achieve combustion. As a result, the fuel does not combust.

SUMMARY OF THE INVENTION

A system and method to control fuel delivery to an engine at startup includes a crank sensor that determines a rotational position of the engine. A control module calculates an air mass of a first cylinder based on the rotational position of the engine and delivers fuel to the first cylinder based on the air mass. The air mass is based on a volume, a pressure and a temperature of the first cylinder.

According to various embodiments the control module calculates an air mass of remaining cylinders in the engine and delivers fuel to the remaining cylinders based on the air mass of the remaining cylinders. The control module calculates an intake manifold air mass based on the air mass of the first and remaining cylinders. An intake manifold pressure is calculated based on the intake manifold air mass. A throttle is adjusted based on the intake manifold pressure.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
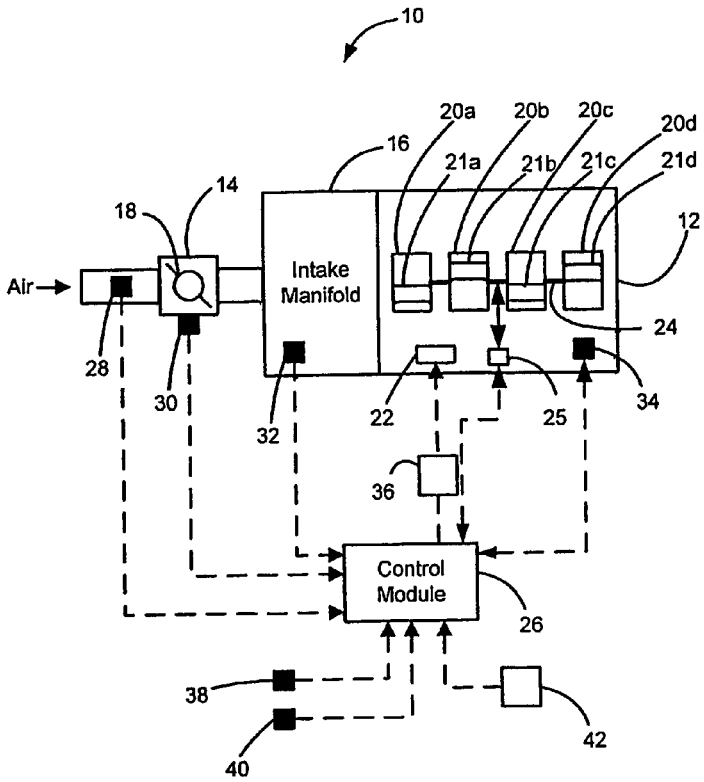
FIG. 1 is a functional block diagram illustrating an engine control system according to various teachings of the present invention.

The following description of the preferred embodiment(s) is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

Referring now to FIG. 1, a vehicle system 10 includes an engine 12. The engine 12 includes a throttle 14 and an intake manifold 16. Air flow through the throttle 14 and into the intake manifold 16 is based on a position of a throttle plate 18. The engine 12 includes cylinders 20*a*–20*d* having pistons 21*a*–21*d*, respectively. Although FIG. 1 depicts four cylinders, it can be appreciated that the engine 12 may include additional or fewer cylinders. For example, engines having 2, 4, 5, 8, 10, 12 and 16 cylinders are contemplated.

Air flows into individual cylinders 20*a*–20*d* of the engine 12. The pistons 21*a*–21*d* each compress an air/fuel mixture. More specifically, air flow into the cylinders 20*a*–20*d* is mixed with fuel injected by a fuel injector 22. A spark plug associated with each cylinder (not shown) ignites the compressed air/fuel mixture in a combustion process to produce engine torque.

A crankshaft 24 receives reciprocating motion from the pistons 21*a*–21*d* and converts it to rotary motion. A crank sensor 25 associated with the crankshaft 24 generates a position signal indicating a rotational position of the engine 12 to a control module 26 when it comes to rest. In one example, a pair of crank sensors 25 are used to determine the rotational position of the engine 12 and whether the engine 12 is rotating in a forward or reverse direction.

The control module 26 controls fuel delivery to the engine 12 at start up based on the start up control of the present invention. The control module 26 communicates with a mass air flow (MAF) sensor 28, a throttle position sensor (TPS) 30, a manifold absolute pressure (MAP) sensor 32 and an engine speed sensor 34. The MAF sensor 28 generates a signal indicating the amount of air flow through the throttle 14. The TPS 30 generates a signal indicating the position of the throttle plate 18 and the MAP sensor 32 generates a signal indicating the pressure within the intake manifold 16. The control module 26 adjusts the engine torque based on a requested torque.

The engine speed sensor 34 generates a signal indicating the engine speed (RPM). The control module 26 also communicates with the fuel injector 22 to control the fuel rate provided to the cylinders 20*a*–20*d* and an ignition system 36 to control timing of the ignition spark. Ambient pressure and temperature signals are generated by ambient pressure and temperature sensors 38, 40, respectively.

Startup control will now be described in further detail. The control module 26 uses the Ideal Gas Law and Compressible Flow equations to determine an air mass in a respective cylinder 20$a$–20$d$ during a starting event. The Ideal Gas Law and Compressible Flow equations are reproduced below.

$$PV=nRT \tag{1}$$

where:

P=cylinder pressure during operation;

V=cylinder volume available for combustion;

n=mass, or moles of gas;

R=universal gas constant for air; and

T=ambient temperature $$ThrottleFlow = \Phi\left(\frac{BarCorrect}{TempCorrect}\right)(ThrottleArea)(MaxThrottleFlow) \tag{2}$$

where:

$\Phi=f(MAP/P_{Barometric})$;

BarCorrect=Barometric pressure correction; and

TempCorrect=Temperature correction;

The variables BarCorrect and TempCorrect are barometric pressure and temperature corrections based on ambient pressure and temperature signals generated by the sensors 38 and 40, respectively that may be determined through a lookup table. ThrottleArea and MaxThroffleFlow are based on a throttle position provided by the TPS 30 and may be determined through a lookup table.

Figure 2:
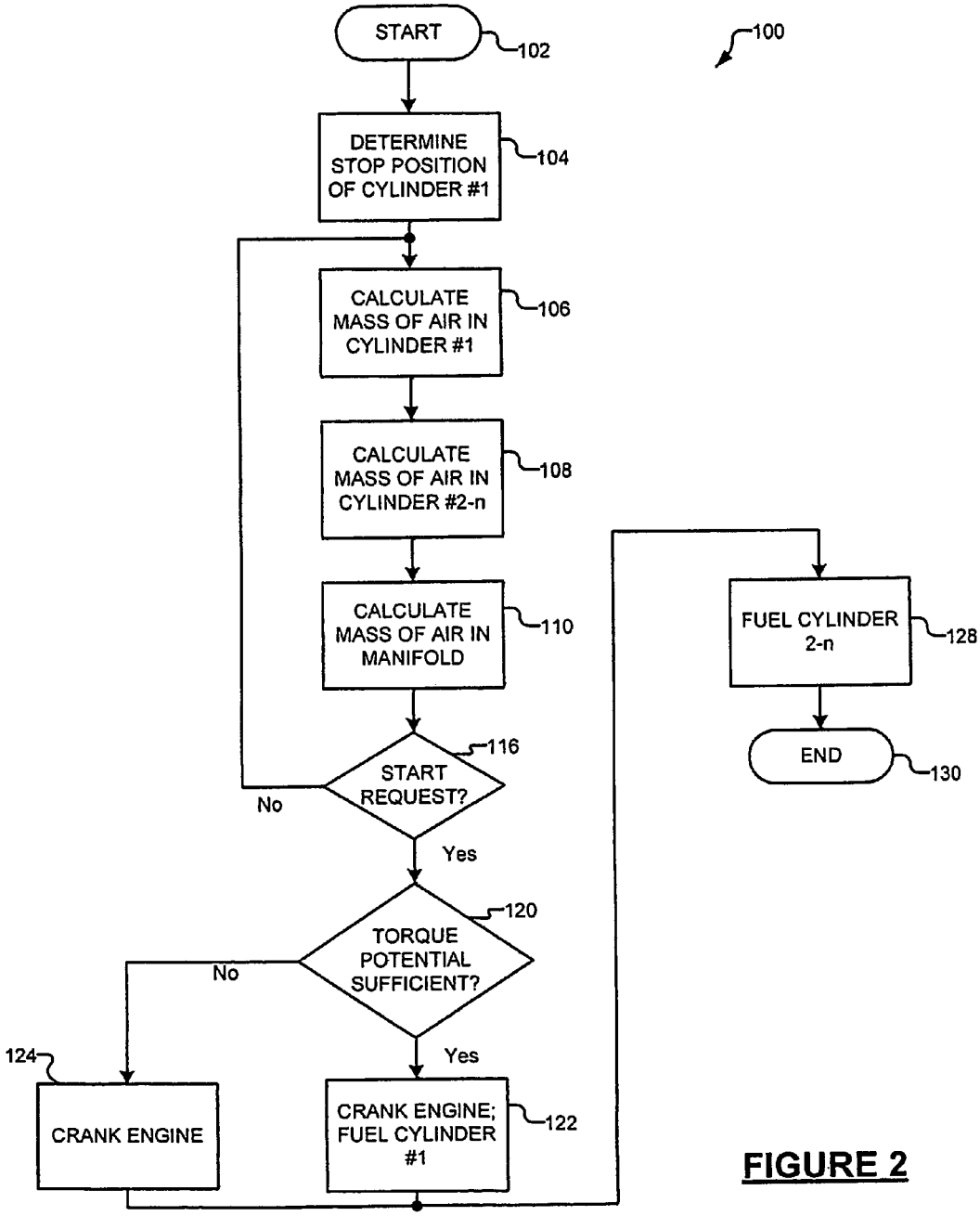
FIG. 2 is a flow chart illustrating an engine startup control determining cylinder charge according to various teachings of the present invention.

With reference to FIG. 2, a method 100 for startup control according to an embodiment of the present invention will be described in greater detail. Control begins in step 102. In step 104, control determines a stop position of a first cylinder 20$a$–20$d$. The first cylinder is identified as the cylinder presently in the compression stroke of the four stroke Otto cycle. The stop position may be determined based on the position signal provided by the crank sensor 25. Once the stop position has been determined, control calculates the mass of air in the first cylinder in step 106. The mass of air is calculated using the Ideal Gas Law equation (1) above. Specifically, control solves for n utilizing known values for the remaining variables. It is appreciated that the cylinder volume V may be calculated based on the stop position of the first cylinder. More specifically, the total cylinder volume and the stop position of the first cylinder (or location of the respective piston) may be utilized to calculate the cylinder volume V available for combustion.

In step 108, control calculates the mass of air in the remaining cylinders 20$a$–20$d$ utilizing respective stop positions and the Ideal Gas Law described above.

In step 110, control calculates the mass of air in the intake manifold 16 utilizing the Ideal Gas Law equation (1 where P is the pressure of the intake manifold 16 at rest and V is the volume of the intake manifold 16. In step 116, control determines if a start request has been received. If a start request has been received, control determines if a torque potential in the first cylinder is sufficient in step 120. If a start request has not been received, control loops to step 106. If the air mass of the first cylinder is sufficient to provide an adequate amount of torque, the engine 12 is cranked and fuel is provided to the first cylinder in step 122. A sufficient torque potential may be an amount of torque necessary to rotate the crankshaft 24 to the next firing event. If control determines there is not sufficient air mass in the first cylinder, control cranks the engine 12 in step 124. Fuel is then provided to the remaining cylinders 20$a$–20$d$ in step 128, control ends in step 130.

Figure 3:
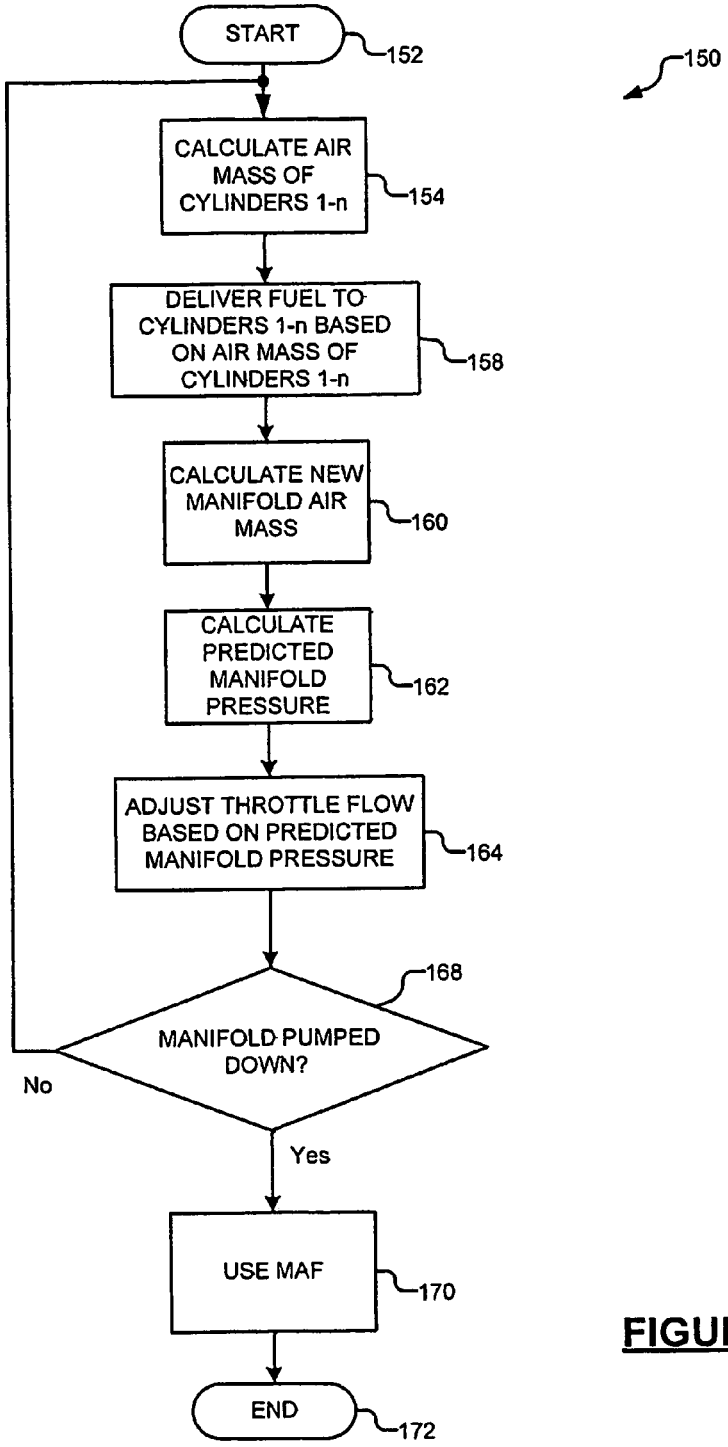
FIG. 3 is a flow chart illustrating an engine startup control for determining pumped air according to various teachings of the present invention.

Turning now to FIG. 3, a method 150 for determining pumped air at startup according to an embodiment of the present invention will be described in greater detail. Control begins in step 152. In one embodiment the method 150 may be performed subsequent to step 128 in method 100. In step 154, control calculates an air mass of the cylinders 20$a$–20$d$ utilizing the Ideal Gas Law equation (1). In step 158, control delivers fuel to the cylinders 20$a$–20$d$ based on the calculated air mass of the cylinders 20$a$–20$d$. In step 160, control calculates the mass of air in the intake manifold 16 using the Ideal Gas Law equation (1). Specifically, control utilizes the following equation:

$$\text{manifold air mass}_{new}=\text{manifold air mass}_{old}-(\text{air mass of cylinders } 1-n) \tag{3}$$

Once the manifold air $\text{mass}_{new}$ has been calculated, a predicted manifold pressure, $MAP_{Predicted}$, is calculated in step 162 utilizing the Ideal Gas Law equation (1) and solving for P, where $P=MAP_{Predicted}$ and n=manifold air $\text{mass}_{new}$;

$$MAP_{Predicted} = \frac{(\text{manifoldair mass}_{new})(R)(T)}{V}$$

Map predicted will vary from actual Map in conditions where the actual rate of engine speed change during start, varies considerably from the norm. In some instances, the best quality and most repeatable starts may occur with the throttle 14 closed or near closed. This also reduces variation associated with a varying total air mass into the intake manifold 16 caused by an increased time exposure.

In step 164, control adjusts air flow through the throttle 14 based on $MAP_{Predicted}$ utilizing the compressible flow equation (2) wherein:

$$\Phi=f(MAP_{Predicted}/P_{Barometric})$$

In step 168, control determines if the intake manifold 16 is pumped down. The intake manifold 16 is pumped down once a pressure drop exists across the throttle 14. If the intake manifold 16 is not pumped down, control loops to step 154. If the intake manifold 16 is pumped down, the MAF sensor 28 is utilized in step 170 to determine subsequent air mass calculations during normal engine operation. Control ends in step 172.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

What is claimed is:

1. A method of starting an engine, comprising:

determining a stop position of a first cylinder;

calculating an air mass in said first cylinder based on said stop position; and delivering fuel to said first cylinder based on said air mass.

2. The method of claim 1 wherein calculating said air mass is based on a volume of said first cylinder.

3. The method of claim 2 wherein calculating said air mass is based on a pressure in said first cylinder.

4. The method of claim 3 wherein calculating said air mass is based on a temperature in said first cylinder.

5. The method of claim 4, further comprising:

calculating an air mass of remaining cylinders in said engine;

delivering fuel to said remaining cylinders based on said air mass of said remaining cylinders.

6. The method of claim 5, further comprising:

calculating an intake manifold air mass based on said air mass of said first and remaining cylinders.

7. The method of claim 6, further comprising:

calculating an intake manifold pressure based on said intake manifold air mass; and adjusting a throttle based on said intake manifold pressure.

8. The method of claim 7, further comprising:

determining if a pressure drop exists across said throttle; and utilizing a mass air flow sensor to determine fuel delivery for subsequent firing events based on said pressure drop.

9. The method of claim 1 wherein said first cylinder is undergoing a compression stroke.

10. A system to control fuel delivery to an engine at startup, comprising:

a crank sensor that determines a rotational position of said engine; and a control module that calculates an air mass of a first cylinder based on said rotational position of said engine and that delivers fuel to said first cylinder based on said air mass.

11. The system of claim 10 wherein said air mass is based on a volume, a pressure and a temperature of said first cylinder.

12. They system of claim 11 wherein said control module calculates an air mass of remaining cylinders in said engine and delivers fuel to said remaining cylinders based on said air mass of said remaining cylinders.

13. The system of claim 12, further comprising an intake manifold wherein said control module calculates an air mass of said intake manifold based on said air mass of said first and remaining cylinders.

14. The system of claim 13, further comprising a throttle, wherein said control module calculates a pressure of said intake manifold based on said intake manifold air mass and adjusts said throttle based on said intake manifold pressure.

15. The system of claim 14, further comprising a mass air flow sensor wherein said control module determines if a pressure drop exists across said throttle and utilizes said mass air flow sensor to determine fuel delivery for subsequent firing events based on said pressure drop.

16. A method of starting an engine, comprising:

determining a stop position of a first cylinder;

calculating an air mass of said first cylinder based on said stop position of said first cylinder;

determining if said air mass has a torque potential sufficient to rotate said engine to a subsequent cylinder firing event; and delivering fuel to said first cylinder based on said torque potential.

17. The method of claim 16 wherein calculating said air mass is based on a volume, a pressure and a temperature of said first cylinder.

18. The method of claim 17, further comprising:

calculating an air mass of remaining cylinders in said engine;

delivering fuel to said remaining cylinders based on said air mass of said remaining cylinders.

19. The method of claim 18, further comprising:

calculating an intake manifold air mass based on said air mass of said first and remaining cylinders;

calculating an intake manifold pressure based on said intake manifold air mass; and adjusting a throttle based on said intake manifold pressure.

20. The method of claim 19, further comprising:

determining if a pressure drop exists across said throttle; and utilizing a mass air flow sensor to determine fuel delivery for subsequent firing events based on said pressure drop.

* * * * *